US009777409B2

(12) United States Patent
Herrmann et al.

(10) Patent No.: US 9,777,409 B2
(45) Date of Patent: Oct. 3, 2017

(54) HEDDLE FOR A LOOM AND LOOM EQUIPPED WITH SUCH A HEDDLE

(71) Applicant: Staubli Lyon, Chassieu (FR)

(72) Inventors: Michel Herrmann, Fontaines sur Saone (FR); Philippe Gaubert, Chassieu (FR); Damien Bouchet, Chaponnay (FR)

(73) Assignee: SYAUBLI LYON, Chassieu (FR)

( * ) Notice: Subject to any disclaimer, the term of this patent is extended or adjusted under 35 U.S.C. 154(b) by 1 day.

(21) Appl. No.: 14/875,876

(22) Filed: Oct. 6, 2015

(65) Prior Publication Data

US 2016/0108562 A1 Apr. 21, 2016

(30) Foreign Application Priority Data

Oct. 16, 2014 (FR) ..... 14 59960

(51) Int. Cl.
*D03C 9/02* (2006.01)
*D03C 9/06* (2006.01)
*D03D 9/00* (2006.01)

(52) U.S. Cl.
CPC ..... *D03C 9/024* (2013.01); *D03C 9/02* (2013.01); *D03C 9/026* (2013.01); *D03C 9/0625* (2013.01)

(58) Field of Classification Search
CPC ..... D03C 9/02; D03C 9/024; D03C 9/026; D03C 3/40; D03C 3/44; D03C 3/42
See application file for complete search history.

(56) References Cited

U.S. PATENT DOCUMENTS 2,267,558 A * 12/1941 Fernberg ..... F16B 21/086 16/86 A
4,245,377 A * 1/1981 Soltes ..... A44C 5/2052 24/625
4,385,754 A * 5/1983 Waite ..... G05G 5/05 267/71
5,309,950 A * 5/1994 Bassi ..... D03C 3/40 139/85

(Continued)

FOREIGN PATENT DOCUMENTS

DE 102007060491 6/2009
EP 2224046 9/2010

(Continued)

OTHER PUBLICATIONS

French Search Report in related French Application No. 1459960, dated Mar. 3, 2015.

*Primary Examiner* — Bobby Muromoto, Jr.
(74) *Attorney, Agent, or Firm* — Dowell & Dowell, PC

(57) ABSTRACT

A heddle for guiding a warp yarn for a loom extends lengthwise along a longitudinal axis (X1) and includes a heddle body including at least one strand and wherein the heddle also includes an eye including a central portion having at least one eyelet for passage of a warp yarn and at least one longitudinal tab that extends longitudinally from the central portion and the eye defines a main plane, and the at least one longitudinal tab also includes at least one cambered part that is deviated in an inclined manner relative to the main plane by deviating the eye over its entire thickness, and which extends over an entire width of the at least one longitudinal tab measured along a lateral axis parallel to the main plane and perpendicular to the longitudinal axis.

14 Claims, 10 Drawing Sheets

(56) References Cited

U.S. PATENT DOCUMENTS

| | | | | |
|---|---|---|---|---|
| 5,379,496 | A * | 1/1995 | Krauss | A44B 11/266 24/115 G |
| 5,819,809 | A * | 10/1998 | Bassi | D03C 3/40 139/85 |
| 7,025,094 | B2 * | 4/2006 | Vanderjeugt | D03C 3/44 139/59 |
| 7,036,532 | B2 * | 5/2006 | Bauder | D03C 3/44 139/52 |
| 2007/0084518 | A1 * | 4/2007 | Himmelstoss | D03C 9/02 139/11 |
| 2008/0083471 | A1 * | 4/2008 | Mettler | D03C 9/024 139/93 |

FOREIGN PATENT DOCUMENTS

| | | |
|---|---|---|
| EP | 2505703 | 10/2012 |
| GB | 200502 | 11/1923 |

* cited by examiner

X1
X2
Y1
Y2
Z2
1
2
4
10
11A
11B
12
14
16
18
20
20A
20B
21
22
24
26
27
28A
28B
29
42
240
241
242
244
246
290
P
P6
F2
F4
D22
D24
D42
D44
L20
L22
l20
l22

HEDDLE FOR A LOOM AND LOOM EQUIPPED WITH SUCH A HEDDLE

BACKGROUND OF THE INVENTION

Field of the Invention

The invention relates to a heddle for guiding a warp yarn for a loom. The invention also relates to a loom equipped with such a heddle.

Brief Description of the Related Art

A loom of the Jacquard type is equipped with a Jacquard mechanism to control several hooks. Each hook controls one or more arches. Each arch is connected to one end of a guide heddle for a warp yarn, which is connected by another end to the frame of the loom via a return spring. Each heddle is provided with an eyelet for passage of the warp yarn and is made up of an eye and a heddle body including two strands. These parts can be manufactured separately. The heddle is then called composite and requires assembly before its placement.

In this respect, it is known from EP-A-1,908,863 to use a heddle body manufactured from a plastic material and an eye made from ceramic or a hard metal. The heddle body is overmolded on the eye. This overmolding method generates burrs when the mold closes around the eye during the injection of the plastic material. The heddles must be gone over again by polishing to eliminate the burrs. Indeed, the burrs may destroy adjacent yarns when they rub on the heddle during weaving.

In this respect, an approach disclosed by document CN-A-101323999 makes it possible to limit the catching of yarns by rubbing against the heddles during weaving. This document proposes a construction of the heddle where the strands are overmolded on the eye. In particular, the eye includes two through holes arranged on either side of the central eyelet and two housings emerging toward the end of the eye and that do not protrude past it on either side. During the overmolding, the strands fill the aforementioned housings and holes and become fastened to the eye. However, this approach requires an eye whose central portion with eyelet has a thickness identical to the thickness of the strand at the assembly zone. The heddle built in this way is therefore bulky.

Furthermore, EP-A-2,505,703 discloses a heddle which, in the embodiment of FIG. 6, comprises an eye and two strands secured to the eye using two transition portions whose thickness decreases going from the eye toward each adjacent strand. No overlap is possible between the eye and the strands.

GB-A-200,502 discloses a heddle provided with a strand equipped, at each of its ends, with an eyelet configured not for the passage of a warp yarn, but for assembling the heddle on a loom frame.

Lastly, DE-A-10 2007 060 491 discloses a heddle that comprises two strands and an eye including an eyelet. As shown more particularly in FIG. 7, the eye includes a narrower portion of its thickness toward each strand. No longitudinal overlap between the strands and the eye of that heddle can be considered from that state of the art.

SUMMARY OF THE INVENTION

The invention more particularly aims to resolve these drawbacks by proposing a heddle whereof the eye has a small bulk, in particular in the assembly zone between the eye and the strand, while allowing a connection that limits the catching of adjacent yarns and guarantees maximal force resistance.

In that spirit, the invention relates to a heddle for guiding a warp yarn for a loom, the heddle extending lengthwise along a longitudinal axis and comprising a heddle body including at least one strand. The heddle also comprises an eye that includes a central portion including at least one eyelet for passage of a warp yarn and at least one longitudinal tab. This longitudinal tab extends the central position and the eye defines a main plane. According to the invention, the longitudinal tab comprises at least one cambered part that is deviated in an inclined manner relative to the main plane by deviating the eye over its entire thickness, and which extends over the entire width of the longitudinal tab measured along a lateral axis parallel to the main plane and perpendicular to the longitudinal axis.

Owing to the invention, the cambered part makes it possible to obtain an eye portion offset in an overlap zone with the strand, which causes a minimal bulk of the eye.

According to advantageous but optional aspects of the invention, such a guide heddle may comprise one or more of the following features, considered in any technically allowable combination:

- The longitudinal tab is secured to the strand while the heddle body is longitudinally overlapping a zone of the longitudinal tab comprised between the cambered part and a free end of the tab and while the cambered part is aligned, in a direction parallel to the longitudinal axis, with part of the heddle body.
- The longitudinal tab has a constant thickness along the longitudinal axis.
- The cambered part extends parallel to the lateral axis.
- The cambered part is extended toward a free end of the tab by at least one part parallel to the main plane.
- The cambered part delimits a concave niche for receiving a final portion of the strand.
- A free end of the strand is adjacent to and aligned with the cambered part along the longitudinal axis, while the cambered part covers, widthwise, along the lateral axis, the free end of the strand.
- The free end of the strand is positioned withdrawn from a surface of the cambered part, in a direction perpendicular to the main plane, said surface being adjacent to the free end of the strand.
- The longitudinal tab comprises two cambered parts offset along the longitudinal axis and connected by an intermediate part that is offset over a plane parallel to the main plane of the eye.
- The part of the longitudinal tab defining a free end of the tab is coplanar or substantially coplanar to the main plane.
- The longitudinal tab of the eye is received in the receiving cavity arranged on the end of the strand.
- The strand includes at least one housing, the eye includes at least one housing, the housing of the strand is across from the housing of the eye, these two housings together forming a pair of housings, while an assembly member made from a solidified resin is positioned in the pair of housings.
- The heddle comprises a heddle body with two strands and an eye comprising at least one longitudinal tab for securing to each strand, while the central portion is planar and extends along the main plane and while each longitudinal tab comprises at least one cambered part.
- The eye is made from a metal or ceramic material, while the strands are made from a plastic material and while the cambered parts of the two longitudinal tabs of the eye are symmetrical relative to a plane of symmetry of the eye.

The invention also relates to a loom equipped with several guide heddles for a warp yarn. This loom is characterized in that at least one guide heddle is as mentioned above.

BRIEF DESCRIPTION OF THE SEVERAL VIEWS OF THE DRAWINGS

The invention will be better understood and other advantages thereof will appear more clearly in light of the following description, provided solely as a non-limiting example and done in reference to the appended drawings, in which.

DESCRIPTION OF THE PREFERRED EMBODIMENTS

Figure 24:
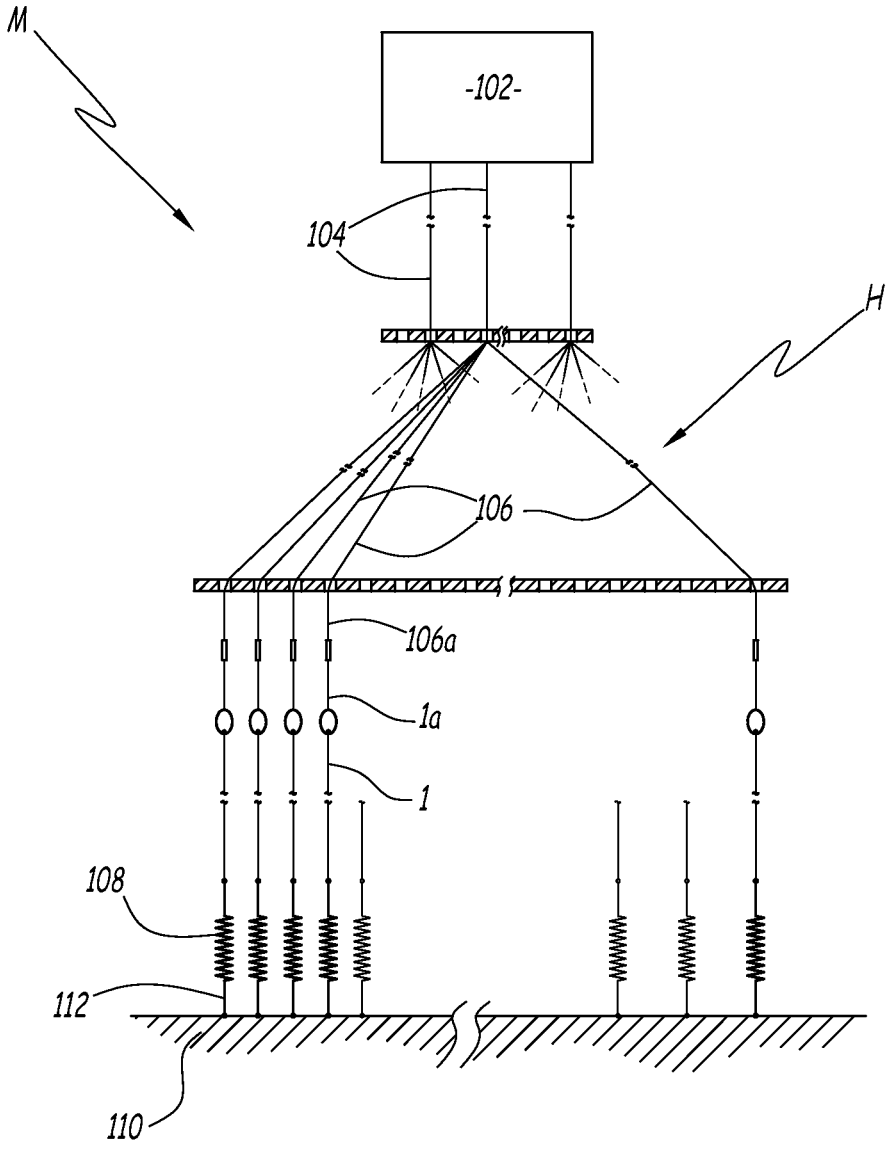
FIG. 24 is a diagrammatic illustration of a loom of the Jacquard type, according to the invention and incorporating one of the heddles shown in FIGS. 1 to 23.

The Jacquard-type loom M shown in FIG. 24 is equipped with a Jacquard mechanism 102 that commands several hooks 104, a lower end of which is associated with several arches 106. A lower end 106*a* of each arch is connected to an upper end 1*a* of a guide heddle 1 of a warp yarn, each heddle 1 being subject to the action of a return spring 108 fastened to a fastening beam 110 by a rod 112, the beam 110 being fastened on a frame of the loom M. The elements 106, 1, 108, 110 and 112 form a harness H of the loom M.

FIGS. 1 to 11 show a first embodiment of a guide heddle 1 of a warp yarn of the loom M.

The guide heddle 1 extends lengthwise along a longitudinal axis X1 and comprises a heddle body 10 and an eye 2. The heddle body 10 includes two separate strands 4. References Y1 and Z1 denote two axes of the heddle 1, perpendicular to the axis X1, the axis Y1 corresponding to the width of the eye 2, while the transverse axis Z1 corresponds to its thickness.

At each end, the heddle body 10 has connecting means 11A or 11B for connecting to a spring 108 or an arch 106. At a first end of the heddle body 10, the connecting means 11A comprise an outer thread 12 that is designed to be screwed on a spring 108. At a second end of the heddle body 10, the connecting means 11B are designed to connect to an arch 106 of the Jacquard harness H. The means 11 comprise an end-piece 14 that forms an opening 16 for passage and jamming of the arch 106 and a rigid connecting tube 18, made from plastic or metal, which is mounted around the strand 4 with the possibility of movement along the axis X1 relative to the opening 16. The connecting means 11B are according to EP-B-1,741,815. Alternatively, other connecting means can be provided at the ends of the heddle body 10.

Figures 1, 2, 3:
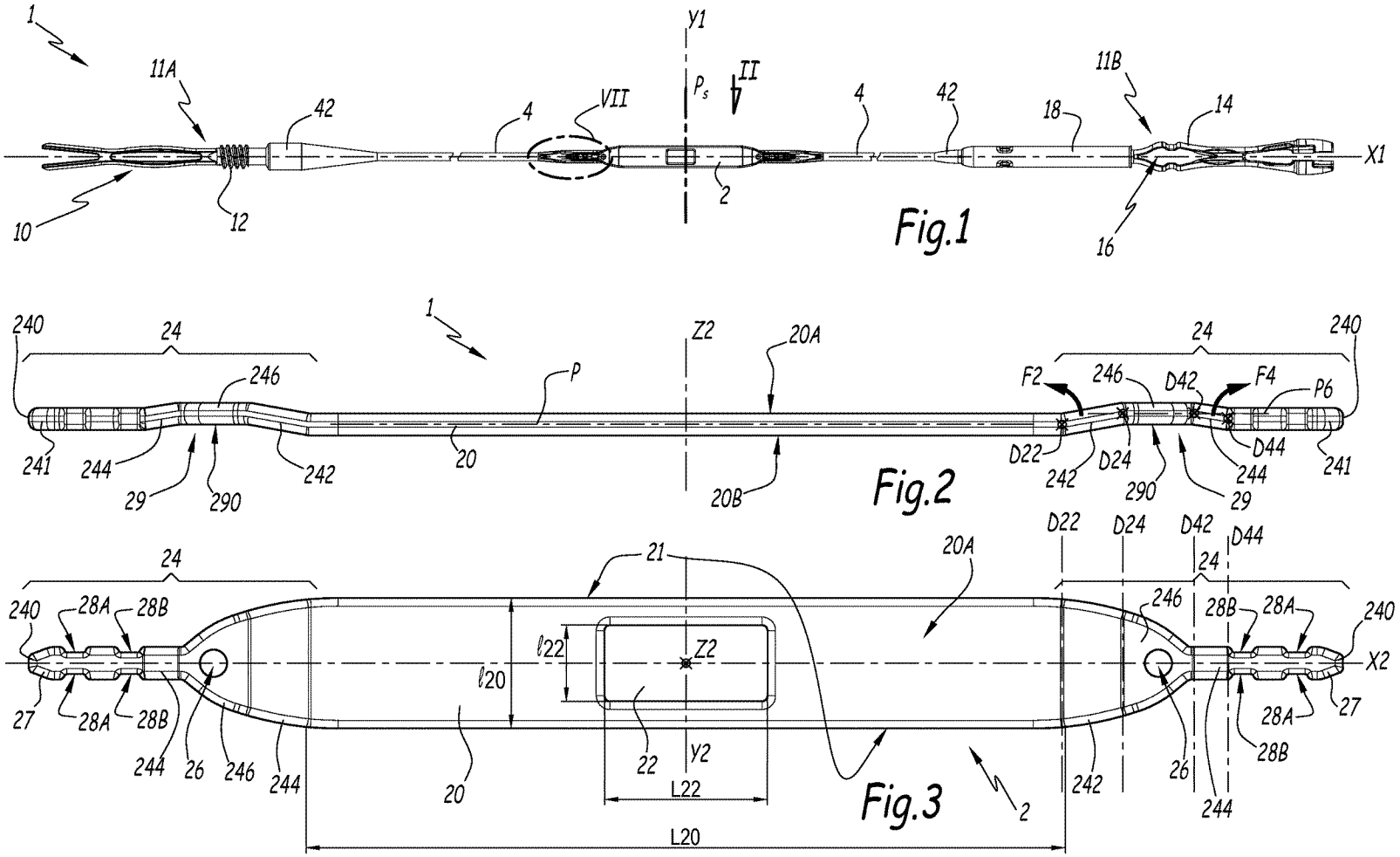
FIG. 1 is an elevation view of a guide heddle for a warp yarn for a loom of the Jacquard type according to a first embodiment of the invention.
FIG. 2 is an enlarged side view along arrow II of an eye of the heddle of FIG. 1.
FIG. 3 is a front view of the eye of FIG. 2.
Figure 8:
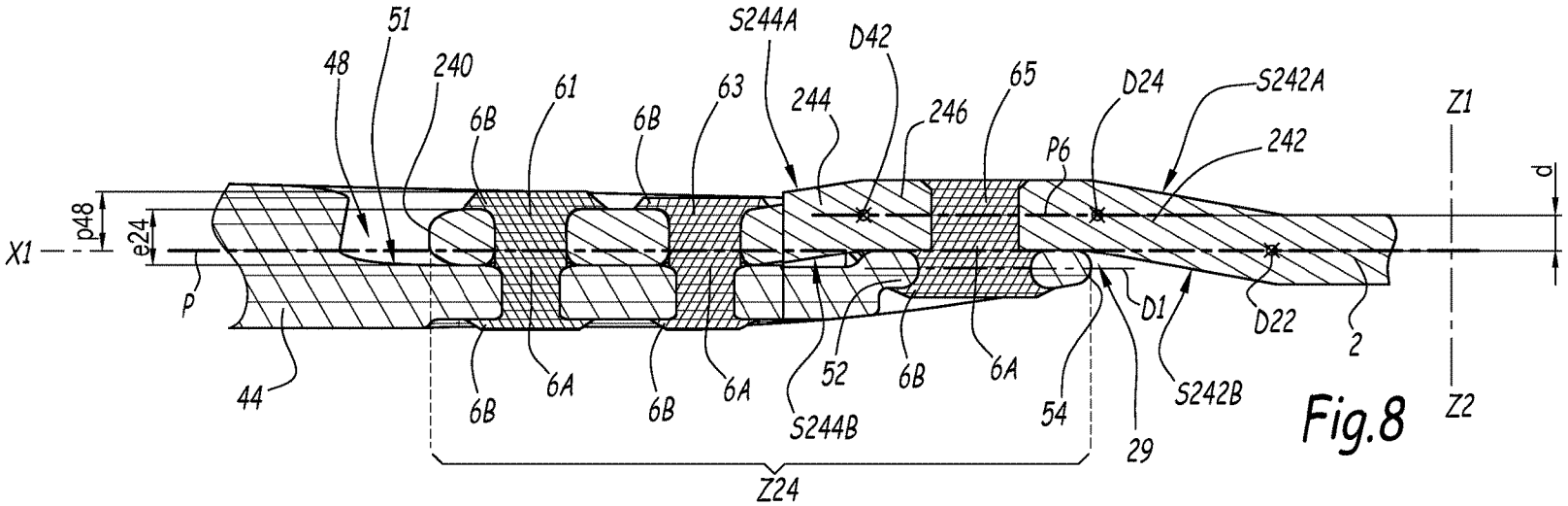
FIG. 8 is an enlarged partial sectional view, along plane VIII-VIII of FIG. 7, of an assembly zone between a strand and the eye.

The eye 2 extends lengthwise along a longitudinal axis X2. Reference Y2 denote a lateral axis, perpendicular to the axis X2. The eye 2 includes a central portion 20 that has lateral rims 21 rounded by polishing. The central portion 20 is provided with two surfaces 20A and 20B with a larger area that are parallel to one another. The central portion 20 defines a main plane P that is parallel to and equidistant from the surfaces 20A and 20B. The plane P is parallel to the axes X2 and Y2. The central portion 20 is provided with an orifice that forms an eyelet 22 for the passage of a warp yarn, said eyelet 22 crossing all the way through the eye 2 along an axis Z2 perpendicular to the axes X2 and Y2. The axes X2, Y2 and Z2 are concurrent at the center of the eyelet 22. The eyelet 22 is rectangular, and its largest section is along the main plane P. FIGS. 1 and 3 are parallel to that main plane P, which is shown in FIGS. 2 and 8.

The thickness of the eye 2 is defined along the normal between its opposite surfaces that are crossed through by the axis Z2.

In the assembled configuration of the heddle 1, the axes X2, Y2 and Z2 are respectively combined with the axes X1, Y1 and Z1 of the heddle 1. The eye 2 is symmetrical relative to a plane of symmetry $P_S$ that contains the axes Y2 and Z2 and relative to a plane of symmetry that contains the axes X2 and Z2.

According to one alternative not shown in the figures, the central portion 20 of the eye 2 includes several eyelets 22 offset in the direction of the longitudinal axis X1.

According to another alternative not shown in the figures, the central portion 20 is provided with at least one lightening hole.

Reference e20 denotes the thickness of the central portion 20.

Reference L22 denotes the length of the eyelet 22 measured parallel to the longitudinal axis X2 and L20 denotes the length of the central portion 20 of the eye 2 measured parallel to the axis X2. This length L20 is greater than or equal to five times the length L22 of the eyelet 22. In particular, the length L20 is greater than 15 mm, preferably between 15 and 25 mm. Reference l22 denotes the width of the eyelet 22 measured parallel to the lateral axis Y2. Lastly, l20 denotes the width of the central portion 20 of the eye 2 measured parallel to the axis Y2. The width l22 of the eyelet 22 is greater than half of the width l20 of the central portion 20 of the eye 2 and is preferably equal to 60% of the width l20. Lastly, as specified above, the eye 2 extends lengthwise along the longitudinal axis X2. More particularly, the length L20 is larger than the length l20.

The central portion 20 of the eye 2 is extended on each side along the longitudinal axis X2 by a longitudinal tab 24. Each tab 24 of the eye 2 has two cambered parts 242 and 244 and ends with a part 241 that defines a free longitudinal end 240. An intermediate part 246 of the tab 24 is positioned, along the axis X2, between the cambered parts 242 and 244. The cambered part 242 longitudinally delimits the tab 24 toward the eyelet 22. The cambered parts 242 and 244 are symmetrical relative to the plane of symmetry Ps.

The parts of the central portion 20 adjacent to the cambered parts 242 and 244 and positioned on either side of the eyelet 22 are coplanar with the main plane P.

The tabs 24 have, along the axis Y2, a width l24 that is reduced relative to the central portion 20 and are relatively far from the eyelet 22. The reduction in width, along the axis Y2, of the tab 24 is gradual, from the central portion 20 toward the free end 240 of the eye 2.

Each part 242 and 244 is cambered transversely to the main plane P of the eye 2, as shown by the arrows F2 and F4 in FIG. 2. In other words, each cambered part 242, 244 is deviated in an inclined manner relative to the main plane P, by deviating the eye 2 over its entire thickness, relative to the adjacent central portion 20, in an inclined manner relative to the main plane P. Thus, the upper face S242A, the upper face S244A, respectively, of the cambered part 242, of the cambered part 244, respectively, extends parallel to the lower face S242B, the lower face S244B, respectively, of the cambered part 242, the cambered part 244, respectively, the upper S242A, S244A and lower S242B, S244B faces being crossed through by an axis parallel to the axis Z2. Likewise, the upper and lower surfaces of the other parts of the tabs 24 that are perpendicular to the axis Z2 are parallel to one another. Each cambered part 242 and 244 is connected to an adjacent part at a bending line parallel to the plane P, in practice parallel to the axis Y2. Thus, the cambered part 242 is defined between two straight bending lines D22 and D24 parallel to the plane P and which respectively connect it to the parts 20 and 246, while the cambered part 244 is defined between two straight bending lines D42 and D44 parallel to the plane P and which respectively connect it to the part 246 and the planar part 241 of the tab 24 defining the end 240. In the figures, the straight lines D22, D24, D42 and D44 are shown equidistant from the opposite surfaces of the tab 24 in the direction Z2.

The cambered parts 242 and 244 therefore extend over the entire width of the tab, width along Y2. Between the straight lines D22, D24, D42 and D44, the parts 242 and 244 have a planar part inclined relative to the main plane and parallel to the axis Y2 and curved parts for connecting to the adjacent parts of the tab 24. The part 246 is planar and parallel to the plane P.

As an alternative that is not shown, the parts 242 and 244 do not include a planar part: in that case, all of the lines forming the surfaces S242A, S242B, S244A and S244B of the cambered part 242, 244 are parallel to Y2, such that the cambered part 242, 244 extends parallel to Y2.

Reference e24 denotes the thickness of a tab 24 near its free end 240. The thickness of the tab is constant and equal to e24 over the entire length of the tab 24, along the axis X1.

The first cambered part 242 shifts the intermediate part 246 relative to the main plane P and the central portion 20, in a direction perpendicular to the plane P. Reference P6 denotes a median plane of the part 246, defined in the same way as the plane P. The planes P and P6 are parallel and offset along the axis Z2 by a non-zero distance d, approximately half of the thickness e24. The second cambered part 244 connects the intermediate part 246 to the free end 240 and returns that end 240 to the vicinity of the main plane P. In other words, the central portion 20 and the part 241 defining the free end 240 are substantially co-planar, the median plane of the part 241 defining the end 240 being shifted by a maximum of one third of the thickness e20 relative to the plane P.

As an alternative to the first embodiment not shown in the figures, the part defining the free end 240 is centered on the main plane P.

For each tab 24, the consecutive cambered parts 242 and 244 delimit a concave niche 29 having a bottom 290 formed by the intermediate parts 246 and therefore offset from the main plane P of the adjacent surface 20B.

Each tab 24 of the eye 2 includes a housing 26 at its intermediate part 246. The housings 26 are formed by holes crossing all the way through the eye 2 parallel to the transverse axis Z2 and have a circular section along the main plane P.

Alternatively, the housings 26 are holes having an oblong or polygonal section along the main plane P.

Reference 27 denotes the longitudinal edges of a tab 24. Each edge 27 is provided with two notches 28A and 28B offset along the axis X2 and that form housings for receiving resin, as shown by the following explanations.

The notches 28A and 28B extend over the entire thickness of the free end 240 along the direction of the transverse axis Z2 and are in the form of rectangular indentations along the main plane P. According to one alternative, the notches 28A and 28B are in the form of semicircular indentations along the main plane P. On each side of the eye 2, the housing 26 and the notches 28A and 28B are offset along the longitudinal axis X2 at three positions.

The eye 2 is made from single-thickness metal. The eye 2 is made by cutting a treated steel sheet and its rims 21 are polished, so as to have rounded shapes not aggressive for the yarns. Alternatively, the eye 2 is made from ceramic or glass. According to another alternative, the eye 2 is made from a synthetic material, in particular polyamide. In practice, the cambered parts 242 and 244 can be obtained by bending the eye 2 at the straight lines D22, D24, D42 and D44 or result directly from its molding.

References X4, Y4 and Z4 respectively denote a longitudinal axis and two transverse axes of a strand 4. In the assembled configuration of the heddle 1, the axes X4, Y4 and Z4 are respectively combined with the axis X1, Y1 and Z1 of the heddle 1.

Each strand 4 comprises a rod 41 having a round section along a transverse plane $P_T$ perpendicular to the longitudinal axis X4 and parallel to the axes Y4 and Z4. The rod 41 extends lengthwise between a first longitudinal end 42, on which the connecting means 11A or 11B are arranged, and a second longitudinal end 44 at which the assembly is done with the eye 2. At the end 44, each strand 4 widens along the lateral axis Y4 and fins along the transverse axis Z4, moving away from the rod 41. In other words, each end 44 has a cross-section that flattens moving away from the rod 41.

At its flat end 44, each strand 4 has a single receiving cavity 48 that partially receives a tab 24 of the eye 2. The receiving cavity 48 emerges on the outside of the strand 4 in the direction of the longitudinal axis X4 and in the direction of the transverse axis Z4. The receiving cavity 48 is laterally delimited in the direction of the axis Y4 by two side walls 49. The receiving cavity 48 includes a bottom 51 that delimits it along the transverse axis Z4. Reference l48 denotes the width of the cavity 48 measured parallel to the lateral axis Y4, between the two side walls 49. The cavity 48 has gradual variations in width l48 along the axis X4.

The bottom 51 of the cavity 48 is extended, in the direction of the longitudinal axis X4 toward the eye 2, by a final portion 52 that is offset in a plane parallel to the main plane P and that protrudes laterally from the side walls 49. The final portion 52 is raised relative to the bottom 51. It limits the outlet of the cavity 1048 along the axis X1. In the assembled configuration of the heddle, the planar part 241 of the tab 24 defining the free end 240 is received in the cavity 48 of the strand 4 with the cavity 48 that emerges along the direction Z1, or in a direction perpendicular to the main plane P and the straight bending lines D22, D24, D42, D44. The final portion 52 is positioned, longitudinally along the axis X1, between the cambered parts 242 and 244 of the tab 24, while being engaged in the niche 29 defined at the intermediate part 246.

The final portion 52 of each strand 4 has a free end 54 corresponding to the terminal longitudinal surface of the final portion 52. The lower surface S242B of each cambered part 242 of the eye 2 is turned toward the adjacent niche 29, while the upper surface S242A is opposite, those two surfaces S242A and S242B both being inclined relative to the main plane P, in the same incline direction relative to the plane P. The free end 54 is positioned withdrawn from that adjacent surface S242B, along the direction of the axis Z1. In other words, the entire surface of the free end 54 is aligned with the surface S242B in the direction X1. Furthermore, the cambered part 244 is positioned, longitudinally along the axis X1, between the cavity 48 and the free end 54 of the final portion 52.

Thus, the assembly between a tab 24 of the eye 2 and an end 44 of a strand 4 takes place in a minimal bulk, since the niche 29 makes it possible to receive the final portion 52 without penalizing the bulk of the central portion 20, as is the case in prior art CN-A-101323999, where the housings are hollowed in the eye to house the strand. Furthermore, the free end 54 of the portion 52 does not risk catching on yarns adjacent to the heddle 1 because that free end 54 is received in the niche 29, across from the cambered part 242, withdrawn from the surface S242B.

The final portion 52 thins toward the final end 54 widthwise along the lateral axis Y4 and also in terms of the thickness along the transverse axis Z4. Reference l242 denotes the minimum width of the cambered part 242 measured parallel to the lateral axis Y2 and l54 also denotes the free end 54 measured parallel to the lateral axis Y4. The width l242 is greater than the width l54 and the cambered part 242 completely overlaps, widthwise along the direction Y2, the final end 54.

The side walls 49 each have a beveled edge 50 toward the final portion 52, the beveled edges 50 producing the transition between the side walls 49 and the final portion 52. Each side wall 49 includes an inner surface 490 that has a rough and/or striated surface obtained directly during manufacturing of the strand 4.

Reference p48 denotes the depth of the receiving cavity 48 measured parallel to the transverse axis Z4 at the side walls 49. The depth p48 varies along the axis X4. In the assembled configuration of the heddle 1, at a same longitudinal level along the axis X1, the depth p48 is greater than the thickness e24, such that, when the tab 24 is received in the cavity 48 of the strand 4 with the tab 24 in contact with the bottom 51, the side walls 49 protrude past the tab 24 in a direction parallel to the axes Z2 and Z4. Each cavity 48 is globally complementary to the tab 24 that it receives.

According to an alternative of the first embodiment that is not shown, the depth p48 is equal to the thickness e24.

Figure 6:
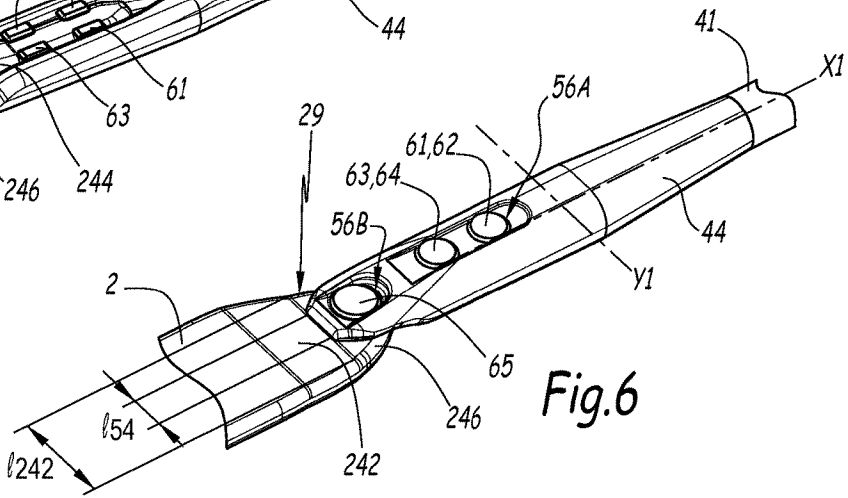
FIG. 6 is a view similar to FIG. 5, from another angle.
Figure 7:
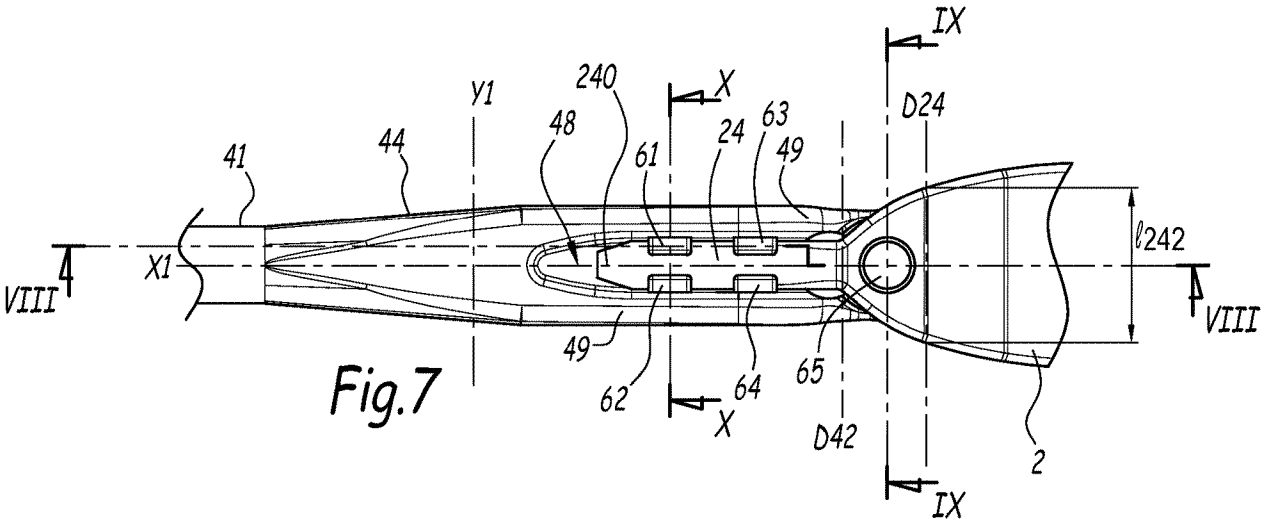
FIG. 7 is an enlarged view of detail VII of FIG. 1.

On the side of the end 44 opposite the receiving cavity 48, and as shown in FIG. 6, two longitudinal slots 56A and 56B are arranged.

Also arranged on the end 44 are three housings 46A, 46B and 46C, which are formed by holes crossing all the way through the end 44 parallel to the transverse axis Z4. The two housings 46A and 46B cross through the bottom 51 of the receiving cavity 48, while the housing 46C crosses through the final portion 52 of the strand 4. The three housings 46A, 46B and 46C are offset along the longitudinal axis X4. On the side of the end 44 opposite the receiving cavity 48, the two housings 46A and 46B emerge in the longitudinal slot 56A and the housing 46C emerges in the longitudinal slot 56B.

Each housing 46A, 46B and 46C has a circular section.

Alternatively, the housings 46A, 46B and 46C are holes having an oblong or polygonal section.

The strand 4 is made from polyamide and is manufactured by injection. Advantageously, the strand 4 is reinforced with fibers, for example glass or carbon fibers. The outer thread 12 and end-piece 14 of the connecting means 11A and 11B form a single piece with the rods 41. The eye 2 has a greater mechanical strength and abrasion resistance than those of the strand 4.

In the configuration with the eye 2 installed in the strand 4, the strand 4 longitudinally overlaps a zone Z24 of the longitudinal tab 24 that goes from the intermediate part 246 to the free end 240. In other words, the zone Z24 extends between the first cambered part 242 and the free end 240. The eye 2 and each strand 4 overlap along the longitudinal direction X1, such that the niche 29 partially receives the final portion 52 of the strand 4. At least one straight line D1 is considered, as illustrated in FIG. 8, parallel to the axis X1 and is situated, along the axis Z1, at the cambered part 242 and the adjacent final portion 52. The cambered part 242 is aligned with the final portion 52 along that straight line D1. In other words, the parts 242 and 52 of the heddle are opposite, or facing, one another in the direction of the straight line D1 that is parallel to the axis X1.

Furthermore, the eye 2 and each strand 4 respectively overlap in the longitudinal direction X1, such that the housings 46A and 46B are respectively axially aligned, along the axis X1, with the notches 28A and 28B and such that the housing 46C is axially aligned, along the axis X1, with the housing 26. The housings 26, 28A and 28B of the eye 2 and housings 46A, 46B and 46C of the strand 4 then form five pairs of housings.

Figure 11:
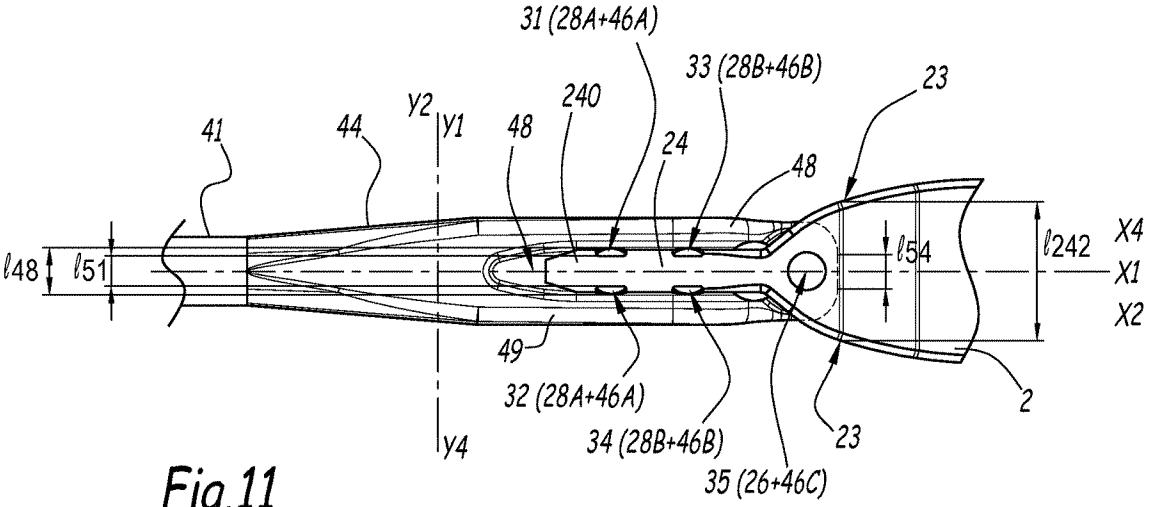
FIG. 11 is a view similar to FIG. 7 before the resin is deposited at the interface between the eye and the strand.
Figure 12:
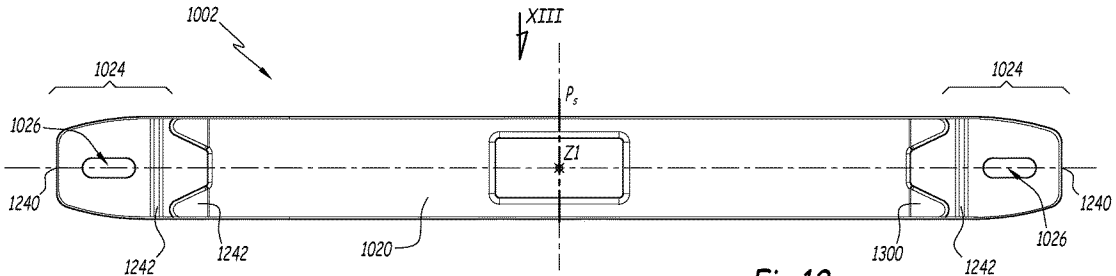
FIG. 12 is an elevation view of an eye belonging to a guide heddle according to a second embodiment of the invention.

At each tab 24, these five pairs of housings are identified with references 31, 32, 33, 34 and 35 in FIG. 11. The pair of housings 31 is formed by the housing 46A and the notch 28A situated above the axis X1 in that figure, and which is closest to the free end 240. The pair of housings 32 is formed by the housing 46A and the notch 28A situated above the axis X1 in that figure, and which is closest to the free end 240. The pairs 33 and 34 are respectively formed by the housing 46B and the notches 28B respectively positioned above and below the axis X1 and that are furthest from the free end 240. The pair of housings 35 is formed by the housings 46C and 26.

During the manufacture of the heddle 1, two strands 4 are placed on a horizontal planar bearing surface, the cavities 48 being open on top. The strand 4, which is designed to be connected to an arch, is provided with a connecting tube 18 prior to the assembly with the eye 2. The eye 2 is next placed on the two strands 4, with its tabs 24 engaged in each of the cavities 48, in contact with the bottoms 51 of the cavities 48.

The housings 26, 28A, 28B of the eye are positioned such that they are at least partially across in pairs from the housings 46A, 46B, 46C of the heddle body. In this configuration of the eye positioned on the two strands of the heddle body, the housings 26, 28A, 28B communicate with the housings 46A, 46B, 46C and emerge on a same side of the heddle along the axis Z1, which makes it possible to deposit the volumes of resin that will make up the set of the assembly members on a same side of the heddle at which the receiving cavities 48 of the strand emerge.

A controlled quantity of epoxide resin is then deposited in each pair of housings 31 to 35. Alternatively, the resin is an acrylic resin. This resin is deposited in each pair of housings when it is still liquid and spreads under the effect of gravity such that it fills each pair of housings. The excess resin is distributed in the slots 56A and 56B and in the receiving cavity 48. Lastly, the resin is hardened by heating under a temperature that depends on its composition. Alternatively, the resin hardens at ambient temperature or under ultraviolet or LED radiation. The resin solidifies in the pairs of housings. The solidified resin then forms assembly members 61, 62, 63, 64 and 65 in the form of rivets that each extend from the eye toward the heddle body along the axis Z1.

The resin is therefore deposited from each housing 26, 28A, 28B of the eye 2 and spreads under the effect of gravity and by capillarity until it reaches the housings 46A, 46B, 46C of the heddle body and in the slots 56A and 56B. The cavities 48 and the tabs 24 of the eye 2 remain visible during the resin placement and hardening operation.

For i comprised between 1 and 5, each assembly member or rivet 6*i* has no clearance in a pair of housings 3*i*. Each rivet 6*i* is a single piece and includes a body 6A that is situated at the pair of housings 3*i*, more specifically, that extends through the eye 2 and through the heddle body 10 along the axis Z1 from the housing of the eye of the pair of housings 3*i* to the inside of the housing of the heddle body of the pair of housings 3*i*. The body 6A extends globally in direction Z1, as shown in FIGS. 8 and 11. Each rivet 6*i* also includes a head 6B, on each side of the body 6A, on either side of the pair of housings 3*i*. The heads 6B are formed by excess resin that overflows on the end 44 in the slots 56A and 56B and on the tab 24 received in the receiving cavity 48. As shown in FIGS. 5 to 8, the heads 6B of the side of the slots 56A and 56B are disk-shaped. On the opposite side, shown in FIG. 5, the head 6B of the rivet 65 is also disk-shaped, while the heads 6B of the rivets 61 to 64 are in the form of rectangular studs with rounded rims.

Figure 10:
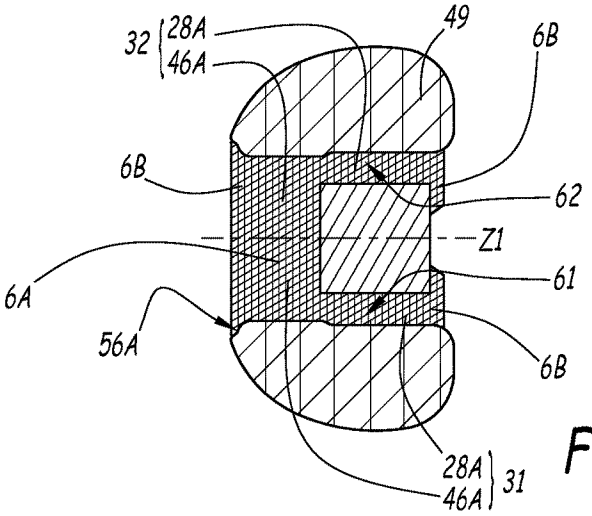
FIG. 10 is an enlarged sectional view along plane X-X in FIG. 7.
Figure 9:
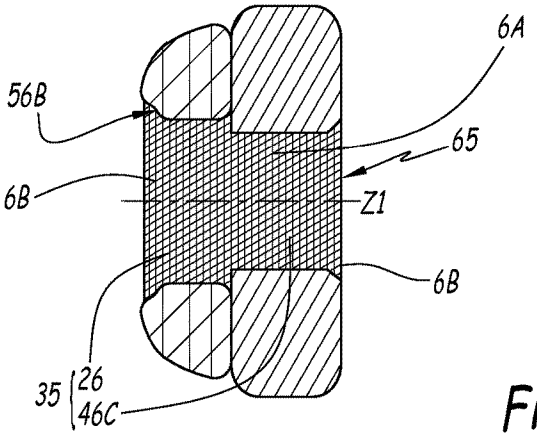
FIG. 9 is an enlarged sectional view along plane IX-IX in FIG. 7.

As more particularly shown in FIG. 10 and inasmuch as the housing 46A is shared by the pairs of housings 31 and 32, the rivets 61 and 62 form a single piece. The same is true for the housing 46B, the pairs 33 and 34 and the rivets 63 and 64.

The geometry of the tabs 24 in particular makes it possible for the rivets 65 to be aligned with the cambered parts 242 in the direction of the axis X1, which is advantageous in terms of compactness and protection of the yarns against catching with the rivets 65.

These rivets 6*i* provide a connection between the final end 44 of each strand 4 and the corresponding tab 24 of the eye 2. The assembly rivets 6*i* act as obstacles positioned between the strand 4 and the eye 2. Indeed, it is necessary for the resin bodies 6A to break to allow a relative movement between the eye 2 and the strand 4 along the longitudinal axis X1. As long as they are not broken, the rivets 6*i* prevent any relative movement. In order to transmit the connecting forces along the axis X1, a section of the body 6A is biased in shear. The connecting forces are therefore not transmitted by adherence at the interfaces of the resin with the body or eye. The heads 6B of the rivets 6*i* prevent the eye 2 and the strand 4 from separating in the transverse direction Z1 and prevent any relative movement between the eye 2 and the strand 4 around the axes X1 and Y1. The volume of resin between the notches 28A, 28B and the edges 49 as well as the rivet 65 blocks the relative movement between the eye 2 and the strand 4 along the lateral axis Y1 and around the axis Z1.

The advantage of using rivets 6*i* placed in the housings in liquid form and which solidify in the housings is that the resin fills and assumes the shape of the housings to form an obstacle, without clearance with the eye or the heddle body, to the relative movement of the eye and the body along at least the axis X1. Using the resin also makes it possible to optimize the geometries of the housings of the pair of housings, which can have different geometries and different sections. The rivets 6*i* do not bias the eye 2 or the strands 4 when they are placed and during hardening of the resin, unlike attached solid rivets in the parts to be assembled. Furthermore, when the resin is deposited, it may extend between several pairs of housings, parallel to the longitudinal axis X1 and lateral axis Y1. The resin then forms bridges that connect the heads 6B of some of the rivets 6*i* to one another. In that case, the mechanical blocking force of the heddle body and the eye is improved.

In that respect, the slots 56A and 56B can, alternatively, be communicating to allow the creation of a bridge between the rivets 63 and 64 on the one hand, and 65 on the other hand.

The rivet bodies 6A, the rivet heads 6B and any bridges, remain contained in the inner volume of the receiving cavity 48 and in the volume of the slots 56A and 56B on the opposite side. The cavity 48 and the slots 56A and 56B then protect the adjacent yarns from rubbing with the rivets 6*i*. The rivets 61, 62, 63, 64 are positioned along the axis X1 between the cambered part 244 and the free end 240 and provide the connection of the heddle body and the eye at the part of the tab 24 that defines the free end 240 and extends in a coplanar manner with the main plane P. Furthermore, the heads 6B of the rivets 61, 62, 63, 64 on the cavity side 48 (upper in FIG. 8) are withdrawn, along Z1, from the surface of the cambered part 244 that is turned opposite the niche 29.

Since the housings receiving the resin cross through the eye 2 and the strands 4 in the direction of the transverse axis Z1, it is possible to inspect the proper placement of the eye 2 relative to each strand 4 and also the proper placement of the resin in the pairs of housings 3*i* for the formation of homogenous rivets 6*i* with controlled sections.

Figure 4:
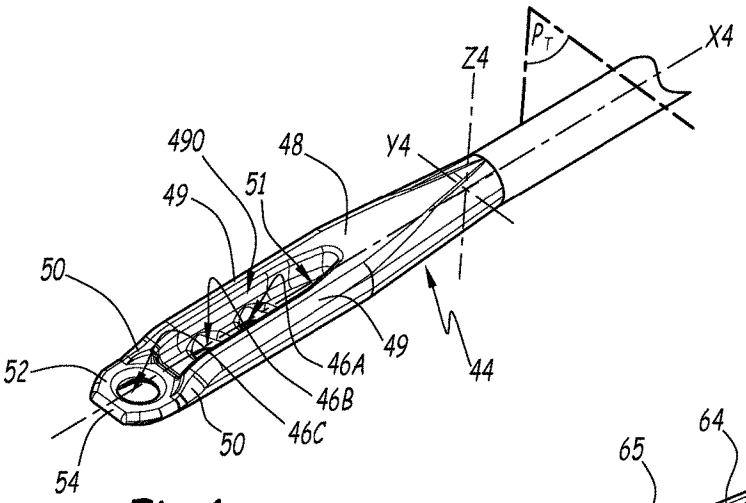
FIG. 4 is an enlarged perspective view of one end of a strand of the heddle of FIG. 1, a cavity being upwardly open in that figure.
Figure 5:
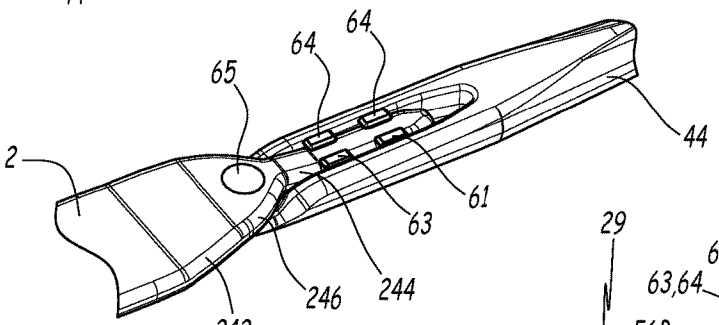
FIG. 5 is an enlarged partial perspective view of an assembly zone between a strand and the eye of the heddle of FIG. 1.

According to an alternative of this first embodiment that is not shown, the cavity 48 can be closed off, opposite the bottom 51, by a ceiling that connects the upper edges of the side walls 49 visible in FIG. 4. In that case, the cavity 48 is partially closed. Also in this case, the two housings 46C can be provided in the final portion 52, while two housings 26 are arranged near the ends of the central portion 20 of the eyelet 2. In the mounted configuration of the heddle, the housings 26 and 46C are aligned in pairs, to the point that it is possible to place rivets, comparable to the rivets 65 mentioned above, in those housings.

FIGS. 12 to 15 show a second embodiment of a guide heddle 1001 for a warp yarn of a loom of the Jacquard type. The elements of the second embodiment bear the same references as those of the first embodiment increased by 1000. Hereinafter, we will not provide a detailed description of the elements of the second embodiment that are similar to those of the first embodiment.

In the second embodiment, the steel eye 1002 is symmetrical relative to the plane of symmetry $P_S$. It includes a central portion 1020 and the two longitudinal tabs 1024. A main plane P of the eye 2 is defined between its two surfaces 1020A and 1020B with a maximal area of the central portion 1020, as in the first embodiment.

The central portion 1020 has, in the direction of the transverse axis Z1, a reduced thickness toward each of the free ends 1240 of the eye 1002. This reduction is obtained by localized crushing of the eye 1002, which is shown by the transitional part 1300. Reference e20 denotes the thickness of the central portion 1020 of the eye 1002 measured parallel to the transverse axis Z1 at the surfaces 1020A and 1020B, and reference e1024 denotes the thickness of the part 1241 of a tab 1024 of the eye 1002 defined along the normal between its opposite surfaces that are crossed through by the transverse axis Z1. The thickness e1024 is smaller than the thickness e20 and constant over the length of the tab 1024, along the axis X1.

Each tab 1024 also has a cambered part 1242 that extends over the entire width of the tab 1024 along the axis Y1 and that longitudinally limits the tab 1024 toward the eyelet of the eye 1002. The transition part 1300 and the cambered part 1242 together define a niche 1029. The cambered part 1242 is positioned longitudinally along the axis X1 between the niche 1029 and the free end 1240 of the eye 1002. Lastly, each tab 1024 has a housing 1026 crossing all the way through it along the direction of the transverse axis Z1 and having an oblong section along the main plane P. Each housing 1026 is positioned longitudinally between the cambered part 1242 and the free end 1240 of the eye 1002.

Reference 1241 denotes a planar part of the tab 1024 that defines the free end 1240. Reference 1248 denotes an intermediate part of the central portion 1020 defined, along the axis X1, between the parts 1242 and 1300. The cambered part 1242 is respectively connected to the intermediate part 1248 and the planar part 1241 that are adjacent, at two straight lines D22 and D24 parallel to the axis X1.

The part 1241 is parallel to the main plane P of the eye 1002.

Figure 13:
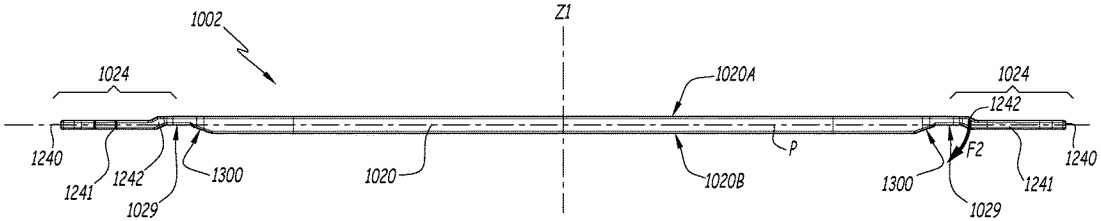
FIG. 13 is a side view along arrow XIII of the eye of FIG. 12.
Figure 14:
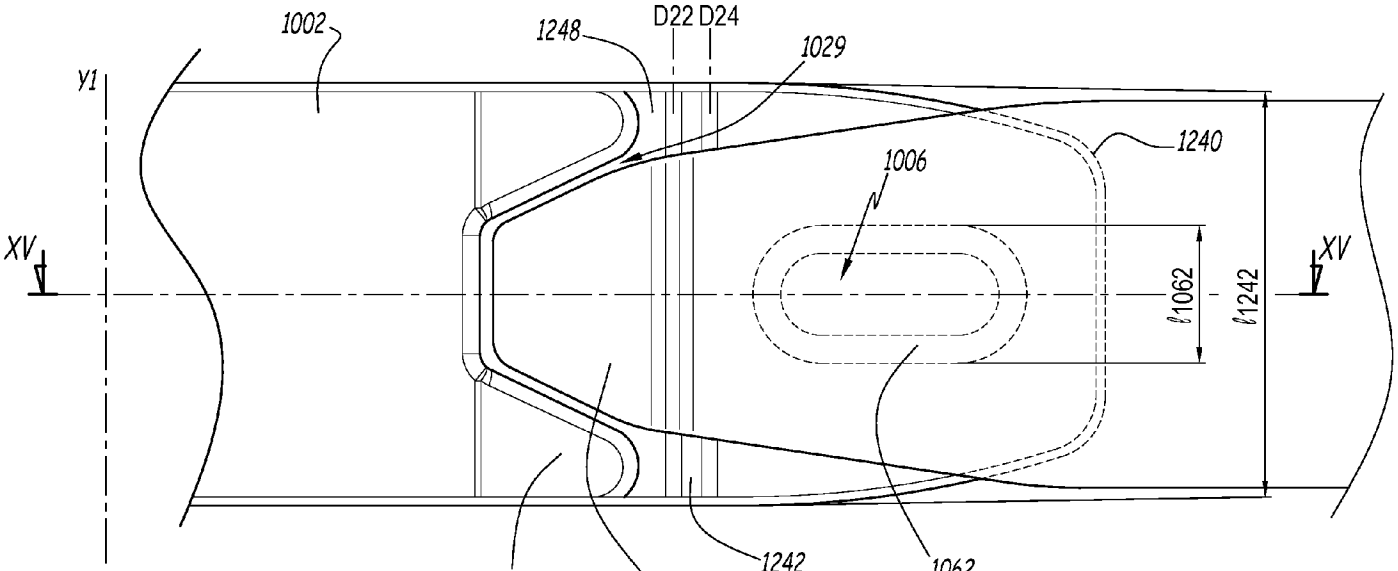
FIG. 14 is an elevation view of an assembly zone between the strand and the eye of FIGS. 12 and 13.

Thus, the cambered part 1242 is deviated in an inclined manner relative to the main plane P, as shown by arrow F2 in FIG. 13.

The cambered parts 1242 of the two tabs 1024 are symmetrical relative to the plane of symmetry Ps.

The heddle body 1010 includes two strands 1004 that have no receiving cavity: each strand 1004 is provided, at its ends 1044, with a projection 1045 projecting along the direction of the transverse axis Z1. The final portion 1052 of a strand 1004 is curved, along the transverse axis Z1, from the side of the adjacent projection 1045.

Each strand 1004 and the eye 1002 longitudinally overlap along the axis X1 and in transverse contact along the axis Z1. More specifically, the strand 1004 longitudinally overlaps the tab 1024 over a zone Z24 that extends from the transition part 1300 to the free end 1240, i.e., comprised between the cambered part 1242 and the free end 1240. Each transverse projection 1045 is received in the corresponding housing 1026 and each final portion 1052 is received in the corresponding niche 1029 of the eye 1002.

Figure 15:
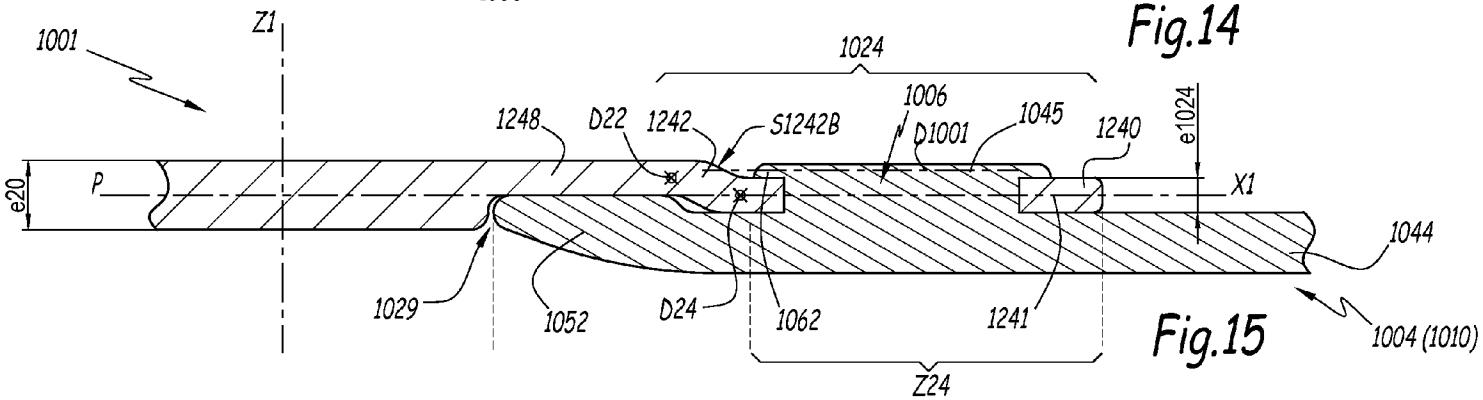
FIG. 15 is a sectional view, along plane XV of FIG. 14.

After placement of the projection 1045 in the housing 1026, a collar 1062 is formed by localized fusion of that projection, for example by ultrasound, hot air or laser. A rivet 1006 is thus formed, which ensures the assembly between the eye 1002 and the strand 1004. Precisely, the rivet 1006 provides the connection of the strand 1044 and the eye 1002 at the part 1241 coplanar with the main plane P. The cambered part 1242 is across from the collar 1062. Reference l1242 denotes the width of the cambered part 1242 measured parallel to a lateral axis Y1 of the heddle 1001. Reference l1062 denotes the width of the collar 1062 measured parallel to the lateral axis Y1. The width l1242 is greater than the width l1062. There is at least one straight line D1001, as illustrated in FIG. 15, parallel to the axis X1 that crosses through both the cambered part 1242 and the adjacent rivet 1006. In other words, the cambered part 1242 is aligned with the rivet 1006 along that straight line D1001. In other words, the cambered part 1242 is across from the rivet 1006 of the heddle body 1010 along the axis X1.

The collar 1062 is withdrawn from the adjacent surface S1242B of the cambered part 1242 of the eye 1002 along the direction Z1, since the entire adjacent surface of the collar 1062 is aligned with the surface S1242B along the axis X1.

The part 1241 of the tab 1024 of the eye 1002 is centered on the main plane P of the central portion 1020 of the eye to limit the biases of the assembly between the strand 1004 and the eye 1002, the eye 1002 keeping a limited bulk and the assembly extending in a limited volume around the axis X1 of the eye 1002.

Figure 16:
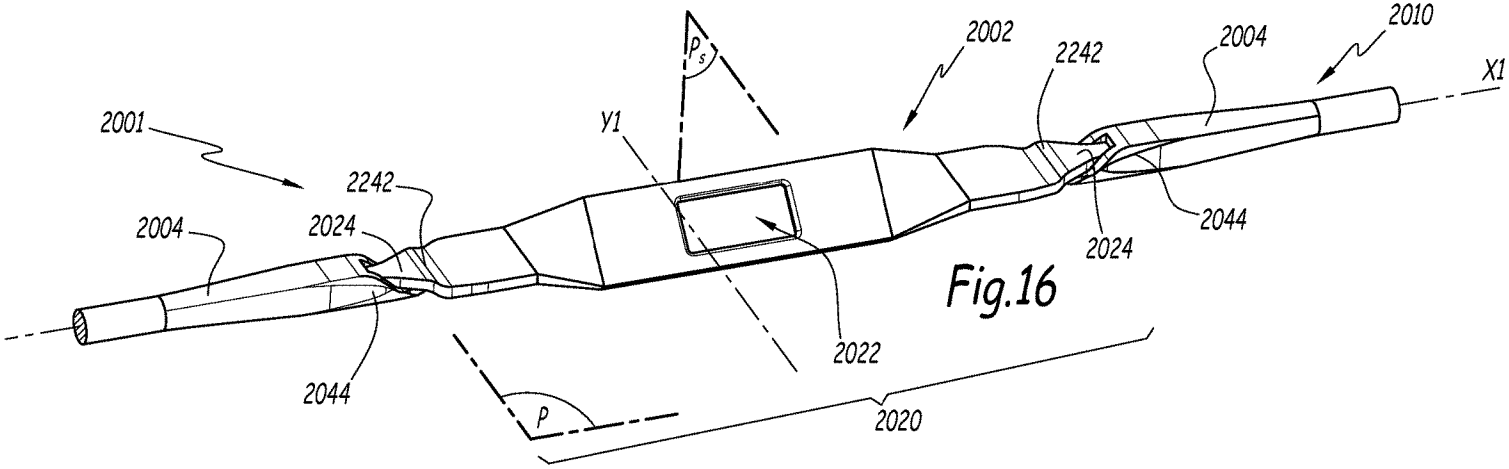
FIG. 16 is a partial perspective view of a guide heddle according to a third embodiment of the invention.
Figure 17:
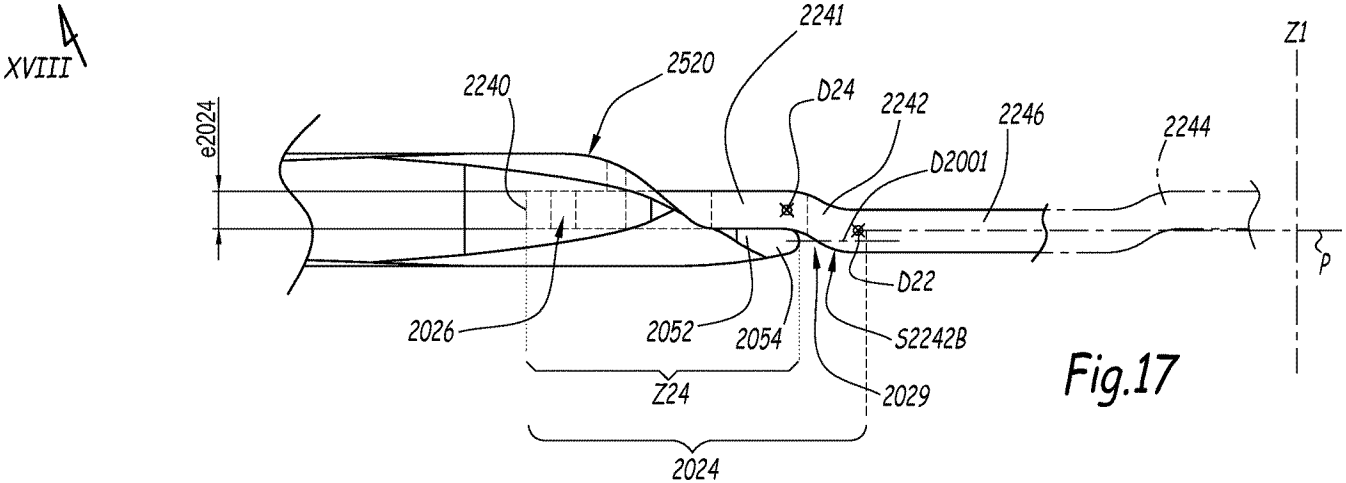
FIG. 17 is a side view, along arrow XVII, of an assembly zone between a strand and an eye of the heddle of FIG. 16.
Figure 18:
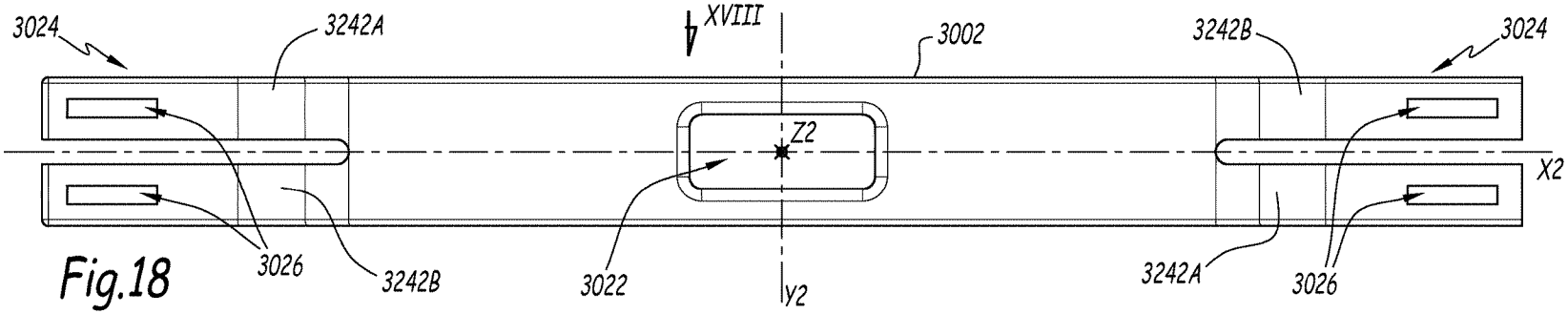
FIG. 18 is an elevation view of an eye belonging to a heddle according to a fourth embodiment of the invention.
Figure 19:
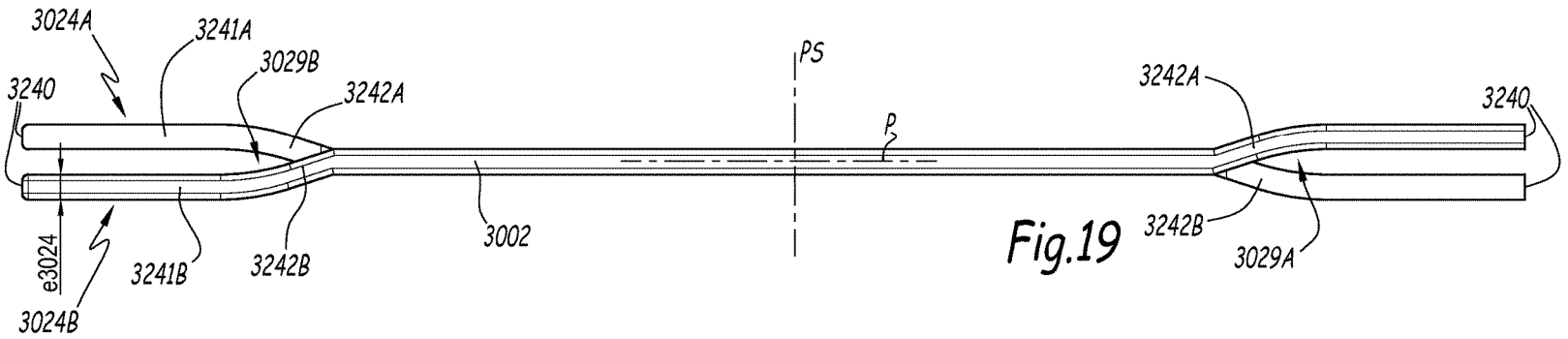
FIG. 19 is a side view along arrow XIX of the eye of FIG. 18.

FIGS. 16 and 17 show a third embodiment of a guide heddle 2001 for a warp yarn for a loom of the Jacquard type. The elements of the third embodiment bear the same references as those of the first embodiment, increased by 2000. Hereinafter, we will not provide a detailed description of the elements of the third embodiment that are similar to those of the first embodiment.

In the third embodiment, the eye 2002 is symmetrical relative to the plane of symmetry $P_S$, as previously defined. It includes a central portion 2020 and the two longitudinal tabs 2024. The eye 2002 is kinked: the central portion 2020 has a part with an eyelet 2022 offset in rotation around the longitudinal axis X1 relative to the tabs 2024. A main plane P of the eye 2002 is defined as a plane parallel to, equidistant from and shared by the two parts of the central portion 2020 that are adjacent to the tabs 2024 and positioned on either side of the eyelet 2022. The kinked part of the main portion 2020 is inclined relative to that main plane P. Reference Y1 denotes a lateral axis perpendicular to the axis X1 and comprised in the main plane P. Each tab 2024 comprises a cambered part 2242 and, beyond that, ends with a planar part 2241 that defines its free end 2240. The cambered part 2242 thus defines a concave niche 2029 positioned longitudinally between the cambered part 2242 and the free end 2240. The cambered part 2242 longitudinally limits the tab 2024 toward the eyelet 2022. The cambered part 2242 is deviated in an inclined manner relative to the main plane P, by deviating the eye over its entire thickness, relative to the part of the adjacent central portion 2020, in an inclined manner relative to the main plane P. The part 2242 is cambered relative to the plane P at two straight lines D22 and D24 parallel to that plane. Reference e2024 denotes the thickness of the tabs 2024, defined along the normal between its opposite surfaces that are crossed through by the axis Z1, near its free end 2240. The thickness e2024 is constant over the entire length of the tab 2024, along the axis X1.

Each tab 2024 is provided with a housing 2026 that crosses all away through it.

The two cambered parts 2242 of the two tabs 2024 of the eye 2002 are symmetrical relative to the plane of symmetry Ps.

The heddle body 2010 includes two strands 2004 each provided with an end 2044 ending with a final portion 2052. Each strand 2004 is overmolded around a tab 2024 of the eye 2002 and is anchored in the housing 2026 of that tab 2024. On one side of the eye 2002, the final end 2054 of each strand 2004 is received in the niche 2029. On the side of the strand 2004, the overmolding forms a surface 2520 of the final portion 2052 sloped relative to the main plane P for a passage without touching of adjacent yarns from the eye 2002 toward the strand 2004 and vice versa.

Here again, the strand 2004 longitudinally overlaps a zone Z24 of the tabs 2024 comprised between the cambered part 2242 and the free end 2240. There is at least one straight line D2001 as illustrated in FIG. 17, parallel to the axis X1 and which crosses through both the cambered part 1242 and the final portion 2052 of the adjacent strand 2004. In other words, the cambered part 2242 is aligned with the final portion 2052 along that straight line D2001. In other words, the cambered part 2242 is across, along X1, from the final portion 2052 of the heddle body 2010.

In FIG. 17 only, an alternative is shown in axis lines along which the tab 2024 is provided with an intermediate portion 2246 and a second cambered portion 2244 arranged longitudinally between the first cambered part 2242 and the central portion 2020 to return the central portion 2020 and the planar part 2241 to a substantially coplanar plane. The final end 2054 of the strands 2004 remains across from the first cambered part 2242. In particular, the final end 2054 is withdrawn from the adjacent surface S2242B of the cambered part 2242. The housing 2026 constitutes a connecting means for the heddle body and the eye and is positioned at the part 2241 coplanar with the main plane P.

FIGS. 18 to 23 show a fourth embodiment of a guide heddle 3001 for a warp yarn for a loom of the Jacquard type. The elements of the fourth embodiment bear the same references as those of the first embodiment, increased by 3000. Hereinafter, we will not provide a detailed description of the elements of the fourth embodiment that are similar to those of the first embodiment.

The heddle 3001 comprises an eye 3002 and a heddle body 3010 including two strands 3004. The eye 3002 is asymmetrical relative to the plane of symmetry $P_S$ defined as for the first embodiment. The eye 3002 has a central portion 3020 with an eyelet 3022 that is extended on each side along the longitudinal axis X2 by two tabs 3024A, 3024B separated by a longitudinal slot, two cambered parts 3242A and 3242B being respectively formed over the entire width of one of the two tabs 3024A, 3024B, the two parts 3242A and 3242B being cambered in opposition. A main plane P of the eye 3002 is defined as a plane parallel to and equidistant from the surfaces between which the eyelet 3022 is pierced. The cambered parts 3242A, 3242B are deviated in an inclined manner relative to the main plane P. The cambered parts 3242A and 3242B each delimit a concave niche 3029A or 3029B. It will be noted that, as in the other embodiments, the cambered parts 3242A and 3242B are extended by parts 3241A and 3241B parallel and offset relative to the main plane P of the eye 3002 and that define the free ends 3240 of the tabs 3024A and 3024B. Each planar part 3241A, 3241B includes a housing 3026 crossing all the way through the tab along the axis Z1

Reference Y2 denotes a lateral axis perpendicular to the axis X2 and comprised in the main plane P. Reference e3024 denotes the thickness of a tab 3024A or 3024B, defined along the normal between its opposite surfaces that are crossed through by the axis Y2, near its free end 3240. The thickness e3024 is constant over the entire length of the tabs 3024A and 3024B, along the axis X2.

The end 3044 of each strand 3004 includes two cavities 3048 that are arranged on two opposite faces of the strand 3004 along the axis Z1, each cavity 3048 having a single lateral wall 3049 and therefore emerging toward the outside of the strand 3004 laterally along the axis Y1 and longitudinally along the axis X1. Each cavity 3048 includes a bottom 3051 along the axis Z1. At each cavity, a housing 3046 extends along the axis Z1 and has a rectangular section along the main plane P. The housings 3046 are blind; they emerge in the corresponding cavity and do not cross through the bottom 3051 along the transverse axis Z1. Each cavity 3048 is extended, in the direction of the longitudinal axis X4 toward the eye 2, by a final portion 3052. In its assembled configuration of the heddle 3001, the cambered parts 3242A and 3242B of the eye 3002 are placed around the ends 3044 of the strands 3004, in the cavities 3048. The 3044 of each strand 3004 is thus housed in the niche 3029A, 3029B. More specifically, each strand 3004 longitudinally overlaps the tab 3024 over a zone Z24 that extends between the cambered parts 3242A and 3242B and the free ends 3240 and each strand 3004 is in transverse contact along the axis Z1 with the eye 3002.

Figure 23:
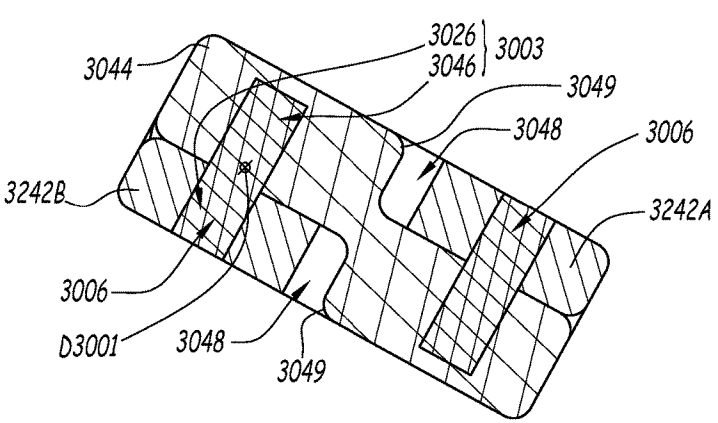
FIG. 23 is an enlarged sectional view, along plane XXIII of FIG. 22.

Thus, each housing 3046 of the strand 3004 communicates, in the direction of the transverse axis Z1, with the corresponding through housing 3026, and together they form pairs of housings 3003. A quantity of resin is deposited in the pairs of housings 3003 of the heddle 3001 and constitutes, once hardened, assembly members 3006 in the form of rivets. Each assembly rivet 3006 is made up of a body extending along the axis Z1, without a rivet head, as shown in FIG. 23, and secures the eye 3002 with each strand 3004 along the longitudinal axis X1 and along the lateral axis Y1. The securing along the transverse axis Z1 is provided by mechanical blocking due to the cooperation of each strand 3004 and the cambered parts 3242A, 3242B on either side of the end 3044 of each strand 3004.

Figure 20:
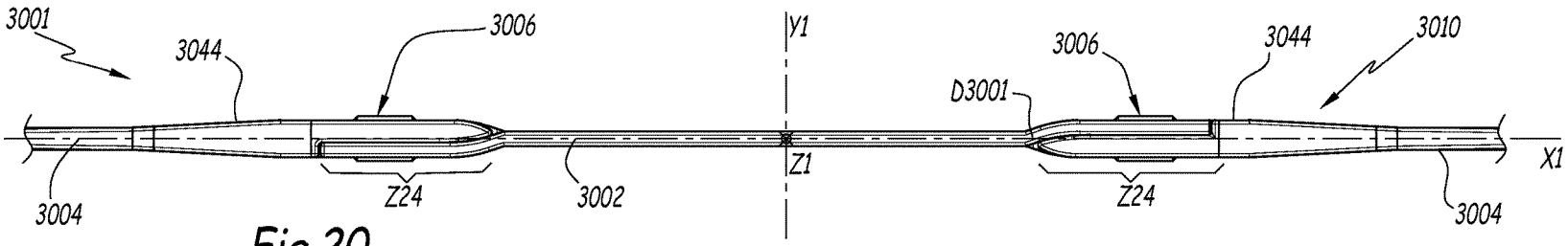
FIG. 20 is a view similar to FIG. 19, when the eye is assembled to strands within the heddle according to the fourth embodiment.
Figure 22:
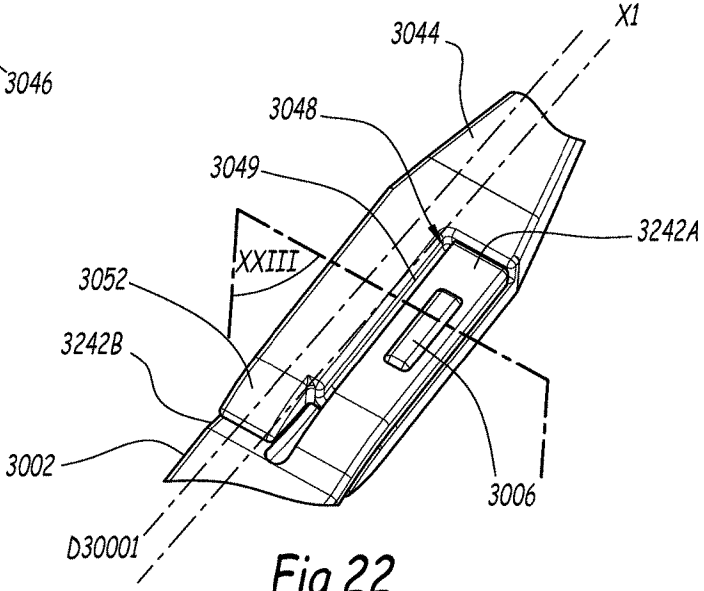
FIG. 22 is a view similar to FIG. 21, when the eye and the strand are assembled.
Figure 21:
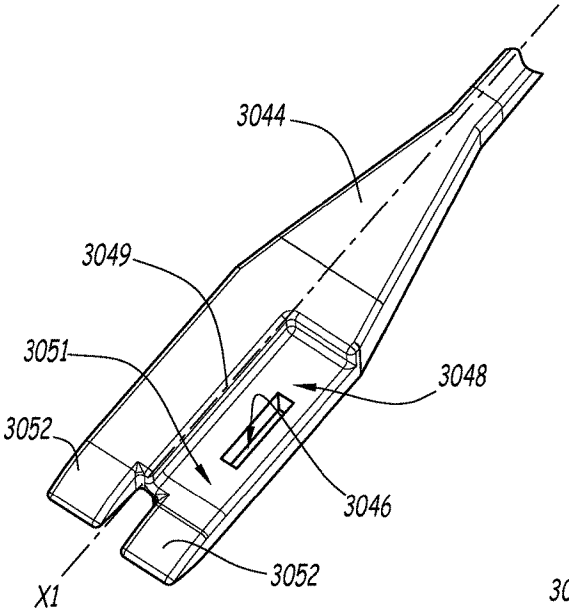
FIG. 21 is a partial enlarged perspective view of a strand of the heddle of FIG. 20.

There is at least one straight line D3001 parallel to the axis X1 that crosses through both the cambered part 3242B and the final portion 3052 adjacent to the strand 3004, as shown by FIGS. 20, 22 and 23. In other words, the cambered part 3242B is aligned with the adjacent final portion 3052 along that straight line D3001. In other words, the cambered part 3242B is across from the final portion 3052 of the body 3010 along the axis X1.

Likewise, the cambered part 3242A is aligned with the adjacent final portion 3052 along a straight line parallel to the axis X1. In other words, the cambered part 3242A is across from the adjacent final portion 3052 of the body 3010 along the axis X1.

Irrespective of the embodiment, the heddle body is preferably made from plastic, but alternatively may be made from metal.

Irrespective of the embodiment, the resin is deposited in the pairs of housings in a liquid state and then solidified such that, in the solidified state, the resin retains its shape and is able to transmit the connecting forces between the eye and the heddle body. The resin can also be deposited solidly with clearance in the housings, then heated in the housings, where it goes to the liquid state to extend in the housings, then solidified. In the solidified state, depending on the type of resin used, the resin may have a higher or lower hardness.

Within the meaning of the present invention, a resin is a natural, artificial or synthetic, thermoplastic or thermosetting polymer product, optionally with an added hardener or additive, such as solid reinforcements, such as fibers.

When the resin is placed in a pair of housings, it occupies a volume of each housing as well as a communication volume between those two volumes.

In all of the embodiments, part of the body and the head of a rivet can be shared by two rivets. Furthermore, each housing of a pair of housings is formed withdrawn from the lateral edge adjacent to the eye or the heddle body.

Within the meaning of the present invention, two housings are across from one another if they are at least partially facing one another and communicate with one another before the deposition of the resin. In particular, when two housings are across from one another in a given direction, the projections of the outlets of the housings of the pair of housings turned toward the other housing of the pair of housings in a plane perpendicular to the facing direction at least partially overlap.

In an alternative that is not shown, the tab has a variable thickness. In particular, this variation in thickness can result from the embodiment of the cambered parts, when they are made by bending, for example. A constant thickness refers to thickness variations smaller than 20%.

The loom M is shown in FIG. 24 with heddles 1 according to the first embodiment. It can also be equipped with heddles 1001, 2001 and 3001 of the other embodiments.

The invention is described above as it applies on a Jacquard-type loom. It is, however, applicable to heddles for frames or frame looms.

The embodiments and alternatives considered above may be combined with one another to create new embodiments.

The invention claimed is:

1. A heddle for guiding a warp yarn for a loom, the heddle extending lengthwise along a longitudinal axis and comprising:

a heddle body including at least one strand, an eye including a central portion including at least one eyelet for the passage of a warp yarn and at least one longitudinal tab that, the at least one longitudinal tab extending longitudinally from the central portion and the eye defining a main plane, the at least one longitudinal tab including at least one cambered part that is deviated in an inclined manner relative to the main plane by deviating the eye over its entire thickness, and which extends over an entire width of the at least one longitudinal tab measured along a lateral axis parallel to the main plane and perpendicular to the longitudinal axis, and the at least one longitudinal tab is secured to the at least one strand, and wherein the heddle body is longitudinally overlapping a zone of the at least one longitudinal tab between the cambered part and a free end of the tab, and the cambered part is aligned, in a direction parallel to the longitudinal axis, with a part of an adjacent heddle body.

2. The heddle according to claim 1, wherein the at least one longitudinal part has a constant thickness along the longitudinal axis.

3. The heddle according to claim 1, wherein the at least one cambered part extends parallel to the lateral axis.

4. The heddle according to claim 1, wherein the at least one cambered part is extended toward a free end of the at least one longitudinal tab by at least one part parallel to the main plane.

5. The heddle according to claim 1, wherein the at least one cambered part delimits a concave niche for receiving a final portion of the strand.

6. The heddle according to claim 1, wherein a free end of the strand is adjacent to and aligned with the at least one cambered part along the longitudinal axis, and wherein the at least one cambered part covers, widthwise, along the lateral axis, the free end of the strand.

7. The heddle according to claim 6, wherein the free end of the strand is positioned withdrawn from a surface of the at least one cambered part, in a direction perpendicular to the main plane, the surface being adjacent to the free end of the strand.

8. The heddle according to claim 1, wherein the at least one longitudinal tab includes two cambered parts offset along the longitudinal axis and connected by an intermediate part that is offset over a plane parallel to the main plane of the eye.

9. The heddle according to claim 1, wherein the cambered part of the at least one longitudinal tab defining a free end of the at least one longitudinal tab is substantially coplanar to the main plane.

10. The heddle according to claim 1, wherein the at least one longitudinal tab of the eye is received in a receiving cavity arranged on an end of the strand.

11. The heddle according to claim 1, wherein:

the at least one strand includes at least one housing, the eye includes at least one housing, the at least one housing of the strand is across from the at least one housing of the eye, the housings together forming a pair of housings which are assemble to one another by solidified resin positioned in the pair of housings.

12. The heddle according to claim 1, wherein the heddle includes a heddle body with two strands and an eye including a separate longitudinal tab secured to each strand, wherein the central portion is planar and extends along the main plane and wherein each longitudinal tab includes at least one cambered part.

13. The heddle according to claim 12, wherein the eye is made from one of a metal or ceramic material, wherein the strands are made from a plastic material and wherein the cambered parts of the two longitudinal tabs of the eye are symmetrical relative to a plane of symmetry of the eye.

14. A loom equipped comprising a plurality of guide heddles for a warp yarn, wherein at least one heddle is according to claim 1.

* * * * *